US006418643B1

(12) United States Patent
Yang

(10) Patent No.: US 6,418,643 B1
(45) Date of Patent: Jul. 16, 2002

(54) SHOE STRUCTURE PROVIDED WITH MEANS TO FASTEN INTERCHANGEABLY VARIOUS INSOLES, PADS, OR INSTEP STRAPS

(76) Inventor: Chen-Yi Yang, No. 117, Tian-Chyr Street, Sha-Luh, Taichung Hsien (TW)

( * ) Notice: Subject to any disclaimer, the term of this patent is extended or adjusted under 35 U.S.C. 154(b) by 0 days.

(21) Appl. No.: 09/912,530

(22) Filed: Jul. 26, 2001

(51) Int. Cl.[7] ..... A43B 3/12
(52) U.S. Cl. ..... 36/101; 36/11.5
(58) Field of Search ..... 36/101, 100, 11.5

(56) References Cited

U.S. PATENT DOCUMENTS 2,368,314 A * 1/1945 Marx ..... 36/101
2,761,224 A * 9/1956 Gardiner ..... 36/101
3,204,346 A * 9/1965 Lockard et al. ..... 36/101
3,983,642 A * 10/1976 Liao ..... 36/101
4,172,330 A * 10/1979 Kao ..... 36/101
4,297,798 A * 11/1981 Colan ..... 36/101
4,839,948 A * 6/1989 Boros ..... 24/303
4,841,648 A * 6/1989 Shaffer et al. ..... 36/101
4,887,369 A * 12/1989 Bailey et al. ..... 36/101
5,991,950 A * 11/1999 Schenkel ..... 12/142 T

* cited by examiner

*Primary Examiner*—Ted Kavanaugh
(74) *Attorney, Agent, or Firm*—Bacon & Thomas, PLLC

(57) ABSTRACT

A footwear. The footwear includes an outsole, an insole, a pad, and an instep strap. The outsole is provided with retaining blocks which are in turn provided with a position confining portion. The instep strap is provided in two longitudinal ends with a retaining piece. The instep strap is detachably fastened with the outsole such that the retaining piece of the instep strap is detachably retained by the position confining portion of the retaining blocks of the outsole.

7 Claims, 14 Drawing Sheets

PRIOR ART
Fig • 1

PRIOR ART
Fig • 2

PRIOR ART
Fig • 3

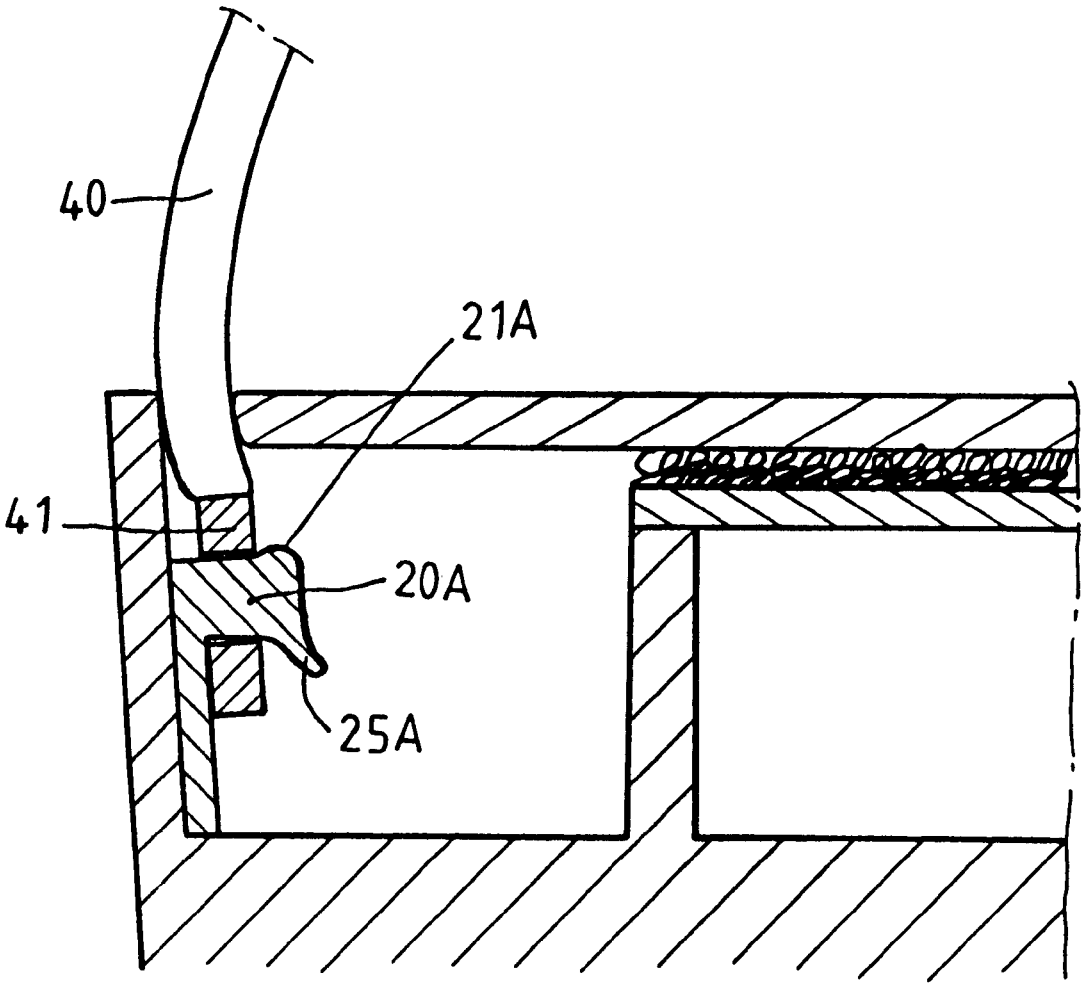
Fig • 1 1

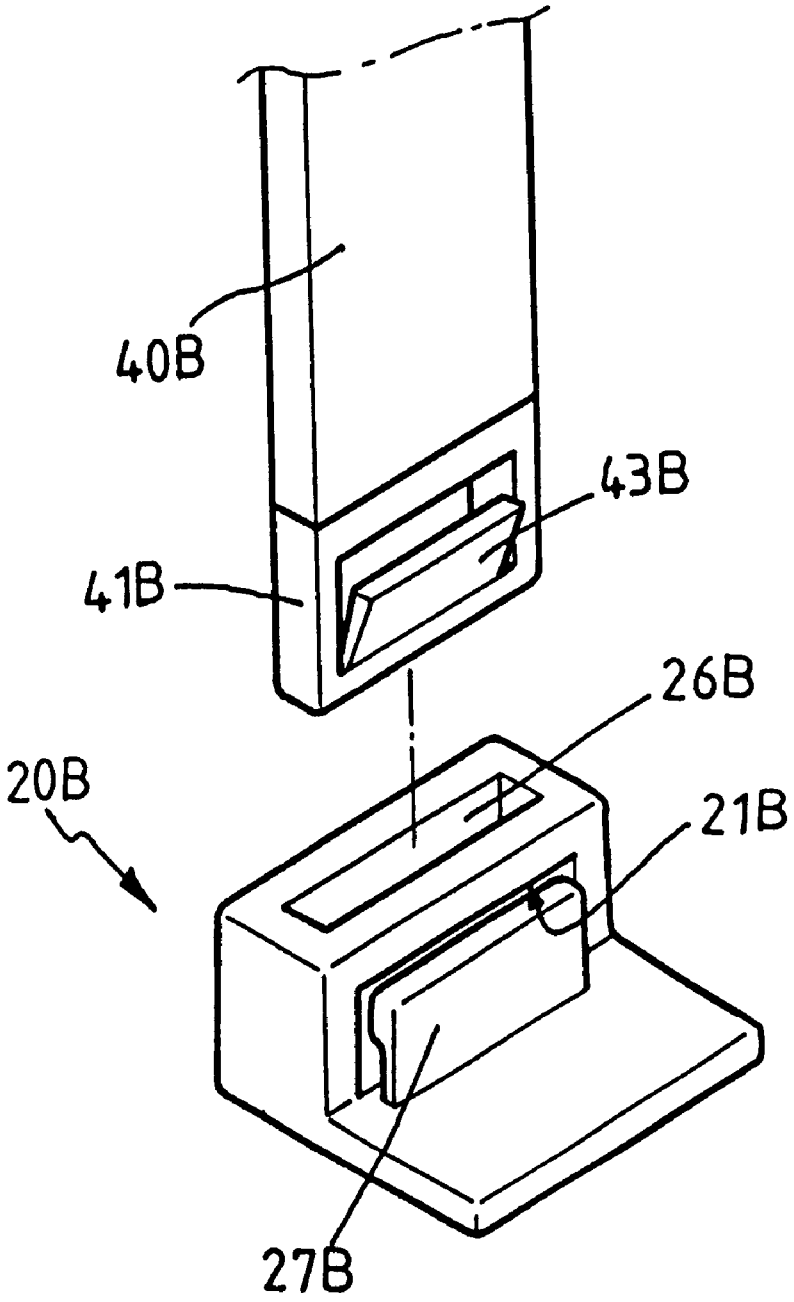
Fig • 1 2

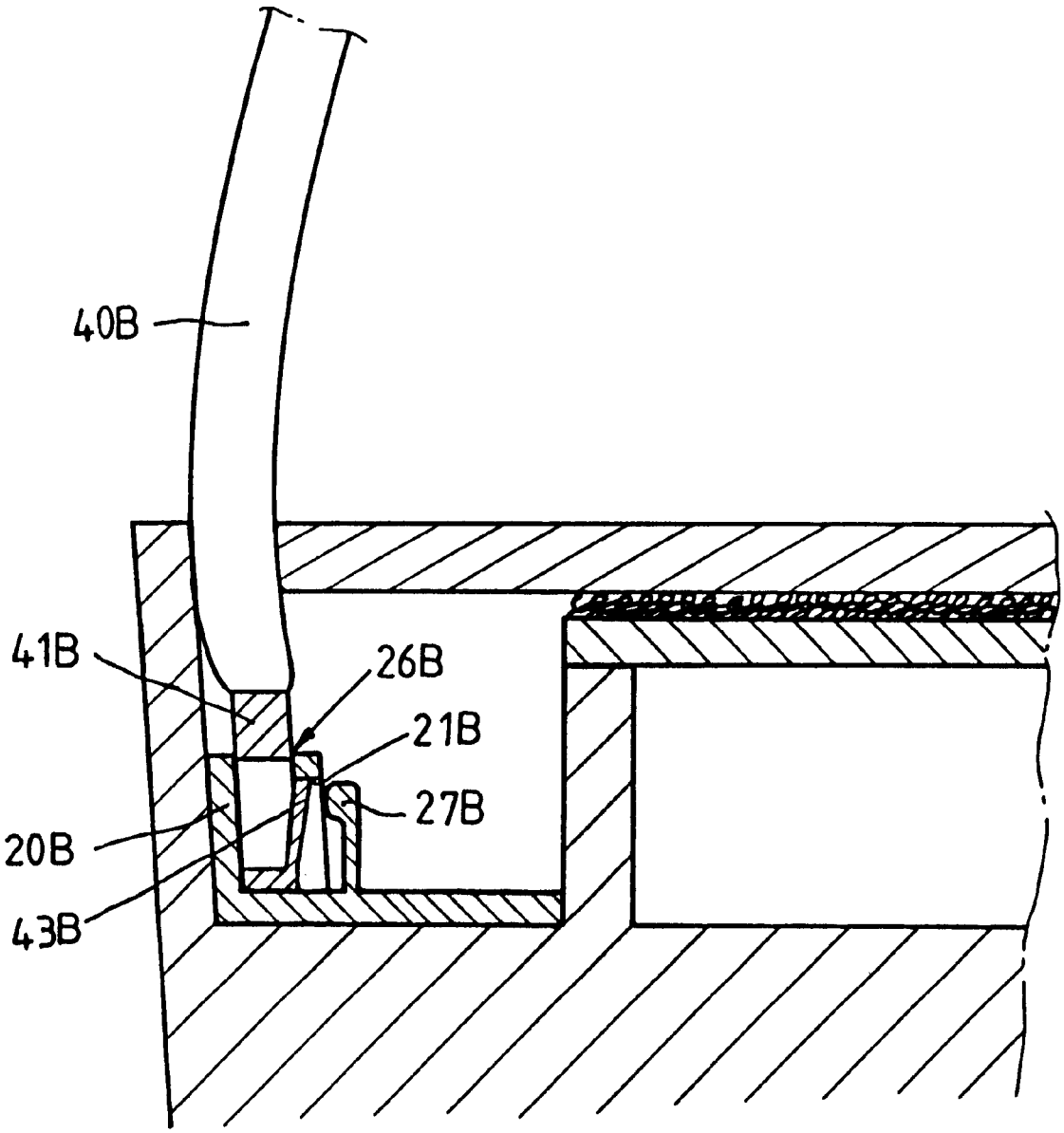
Fig • 1 3

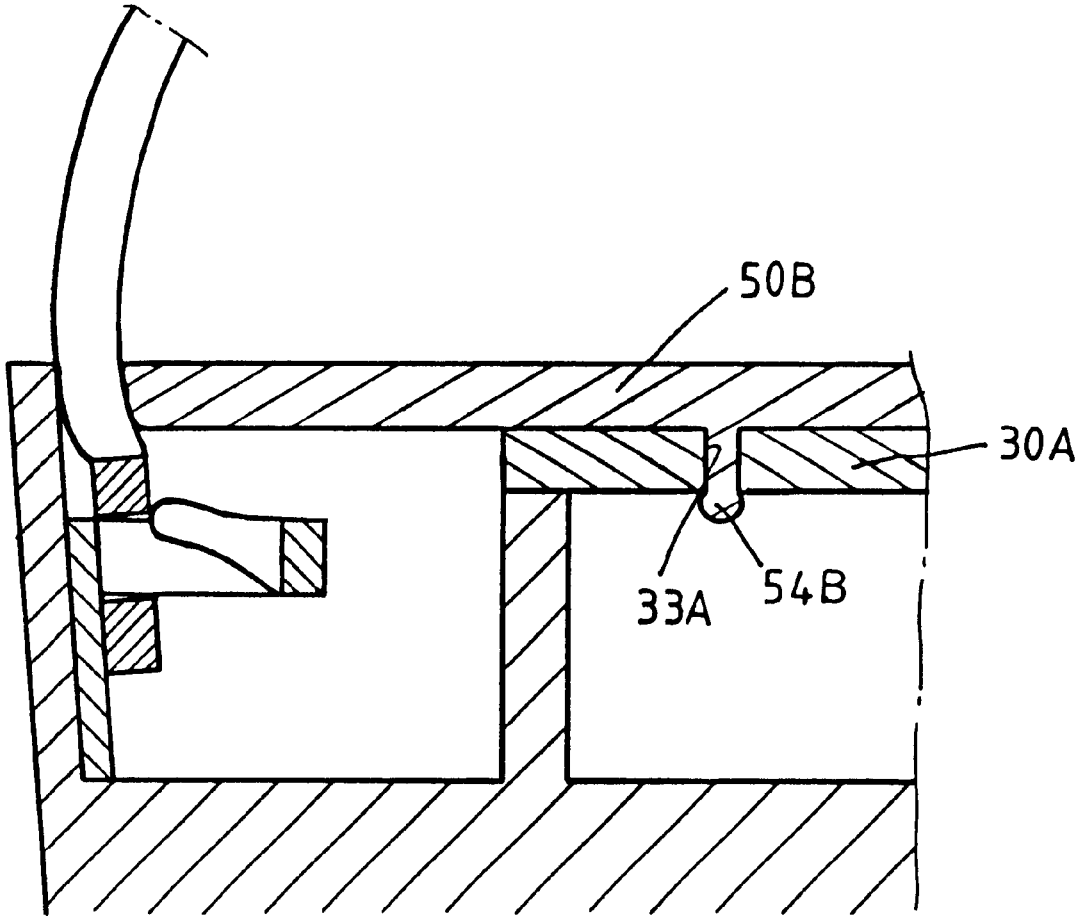
Fig • 1 4

SHOE STRUCTURE PROVIDED WITH MEANS TO FASTEN INTERCHANGEABLY VARIOUS INSOLES, PADS, OR INSTEP STRAPS

FIELD OF THE INVENTION

The present invention relates generally to a footwear, and more particulary to a footwear structure enabling the footwear to have a variety of interchangeable insoles, pads, or instep straps.

BACKGROUND OF THE INVENTION

There are a variety of footwears available in the market place today for the consumers to choose from. In order to enhance the marketability of the footwears, the footwear makers stress the design versatility to catch the fancy of the consumer at large. The case in point is the slipper. The Taiwan Patent No. 85114375 discloses a method for making the slipper, as illustrated in FIG. 1. The method involves the formation of a shoe board 1 by foaming. The shoe board 1 is provided with a plurality of assembling blocks 2, with each having a bevel tooth 21. A vamp strap 3 is provided at both longitudinal ends thereof with a strap piece 31 which is provided with a retaining tooth 32. The vamp strap 3 is fastened to the shoe board 1 such that the retaining tooth 32 of the strap piece 31 is retained by the bevel tooth 21 of the assembling block 2. In other words, the vamp strap 3 is fixedly fastened with the shoe board 1 such that the vamp strap 3 can not be replaced by another vamp strap of a different design or pattern.

The Taiwan Patent No. 87217978 discloses a structure of a do-it-yourself shoe, as illustrated in FIGS. 2 and 3. The structure comprises a shoe board 1 which is formed by foaming and is provided with a plurality of retaining blocks 4, with each having a serrated retaining piece 41. The structure further comprises a vamp strap 5 which is provided at both longitudinal ends with a strap piece 51 having a toothed portion 52. The vamp strap 5 is detachably fastened to the shoe board 1 such that the retaining piece 41 of the retaining blocks 4 is engaged with the toothed portion 52 of the strap piece 51. In light of the vamp strap 5 being detachably fastened with the shoe board 1, the vamp strap 5 can be removed from the shoe board 1 by means of a separation piece 6, as illustrated in FIG. 3. The retaining piece 41 is separated from the toothed portion 52 by the separation piece 6, thereby enabling the vamp strap 5 to be separated from the shoe board 1. This prior art shoe structure has shortcomings. In the first place, the detachment of the vamp strap 5 from the shoe board 1 is attained with assistance of the separation piece 6 which is apt to be lost or misplaced. In addition, the retaining piece 41 is susceptible to deformation which is caused by friction between the retaining piece 41 and the separation piece 6. It is readily apparent that a deformed retaining piece 41 is useless. Moreover, the retaining blocks 4 of the shoe board 1 are not compatible with the vamp straps of other specifications, thereby limiting the design versatility of the prior art shoe structure.

SUMMARY OF THE INVENTION

The primary objective of the present invention is to provide a shoe structure which is free of the drawbacks of the prior art shoe structures described above.

In keeping with the principle of the present invention, the foregoing objective of the present invention is attained by the shoe structure comprising an outsole which is provided in the interior with a plurality of receiving spaces to accommodate a plurality of retaining blocks, with each having a position confining portion curving slightly outward to have a convex surface. The outsole is provided with an insole which is fastened to the upper surface of the outsole and is provided with a plurality of cuts for exposing the retaining blocks of the outsole. The shoe structure further comprises one or more instep straps, with each having a retaining piece. The insole is provided with a shoe pad which is fastened to the upper surface of the insole. The instep straps are fastened with the outsole by means of the retaining piece which is detachably engaged with the retaining blocks of the outsole. A variety of instep straps can be therefore fastened interchangeably with the outsole, so as to enhance versatility of the shoe structure of the present invention.

In light of the position confining portion of the retaining blocks of the outsole of the present invention being of a convex construction, the retaining piece of the instep strap can be separated from the position confining portion of the retaining blocks with a minimum effort and without the help of a separation tool.

The insole of the present invention can be decorated with the shoe pads of various colors and patterns. The shoe pads are fastened with the insole by the VELCRO device which is also known as the magic tape formed of a surface with tiny hooks and a complementary surface with a clinging pile. The male surface (tiny hooks) and the female surface (clinging pile) can be pressed together or pulled apart for easy fastening and unfastening of the shoe pad with the insole.

The features and the advantages of the present invention will be more readily understood upon a thoughtful deliberation of the following detailed description of a preferred embodiment of the present invention with reference to the accompanying drawings.

BRIEF DESCRIPTION OF THE DRAWINGS

FIG. 11 is a partial schematic view to show the structure of another modified retaining block of the present invention.

FIG. 12 is a partial schematic view to show the structure of still another modified retaining block of the present invention.

FIG. 13 shows a schematic view of the working of the retaining block as shown in FIG. 12.

FIG. 14 shows a schematic view of another retaining structure embodied in the present invention.

DETAILED DESCRIPTION OF THE PREFERREDEMBODIMENT

Figure 1:
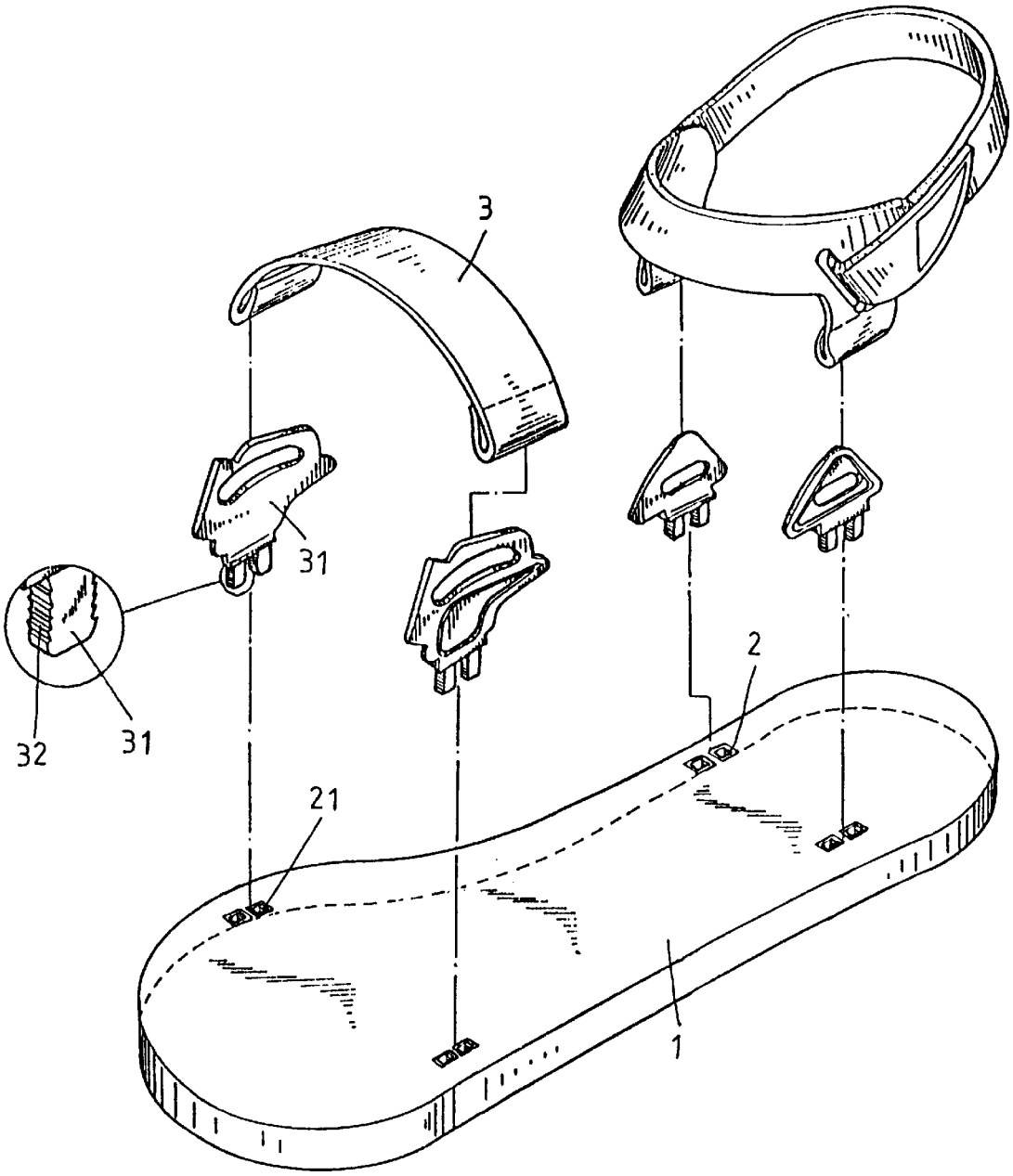
FIG. 1 shows a schematic view of a shoe structure of the prior art.
Figure 2:
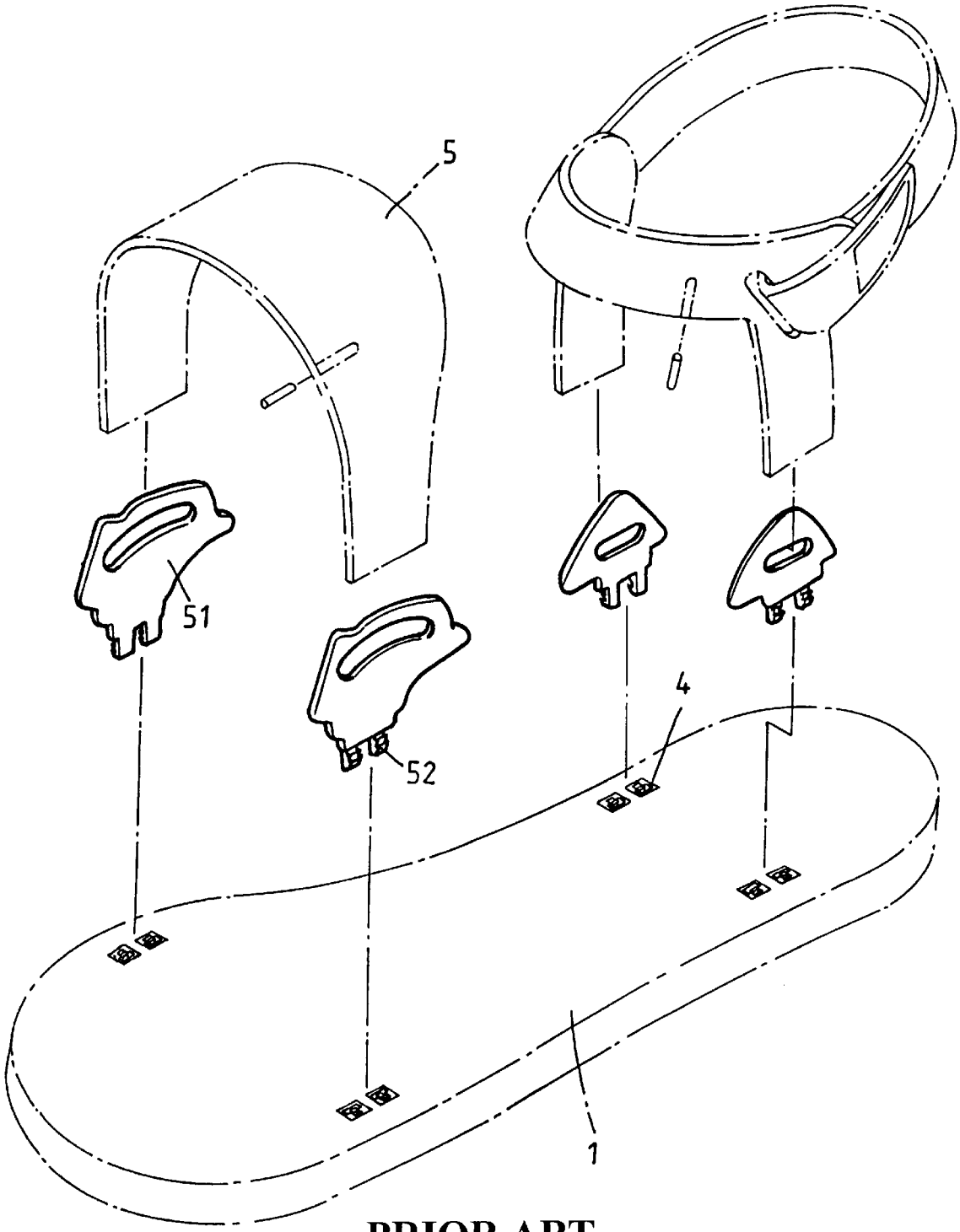
FIG. 2 shows a schematic view of a another prior art shoe structure.
Figure 3:
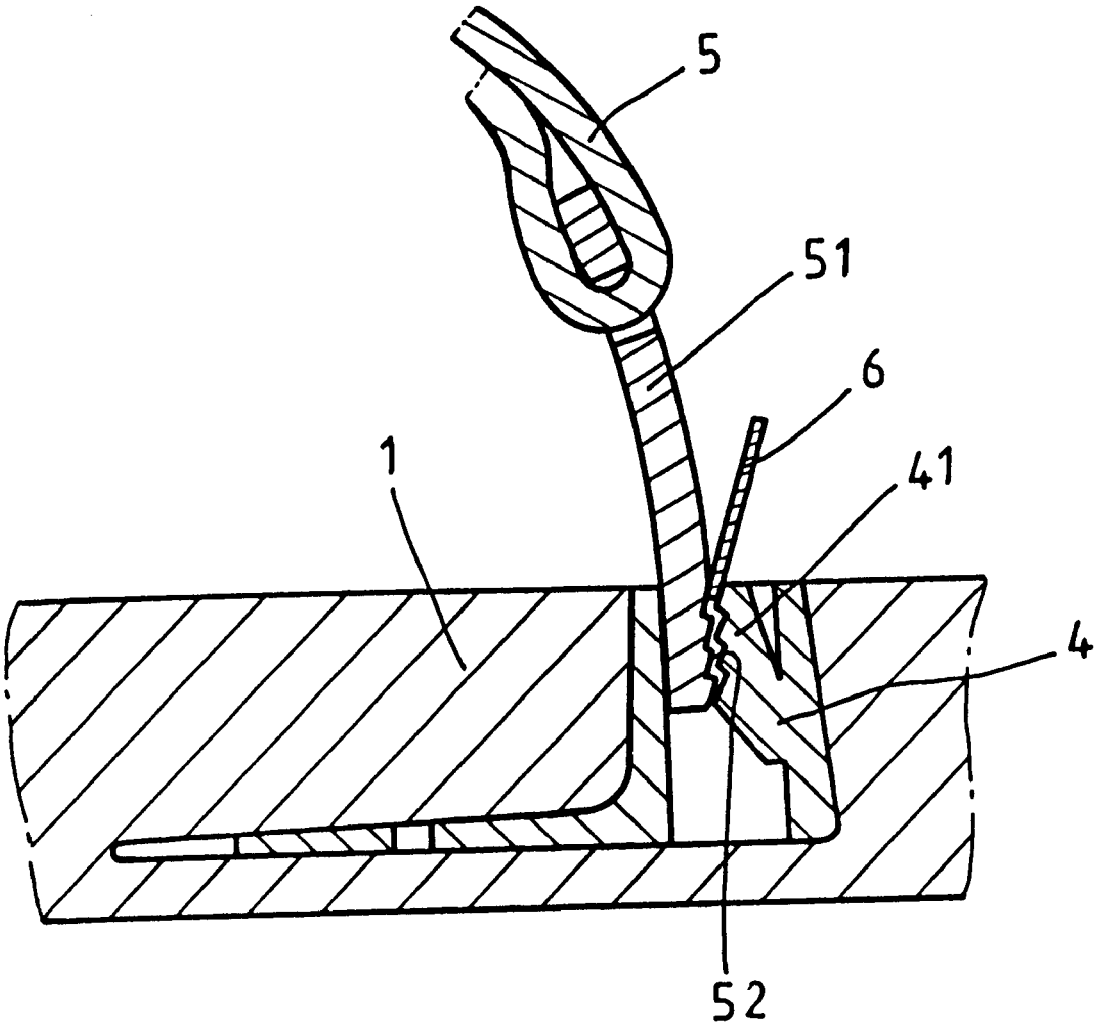
FIG. 3 shows a partial schematic view of the prior art shoe structure as shown in FIG. 2.
Figure 4:
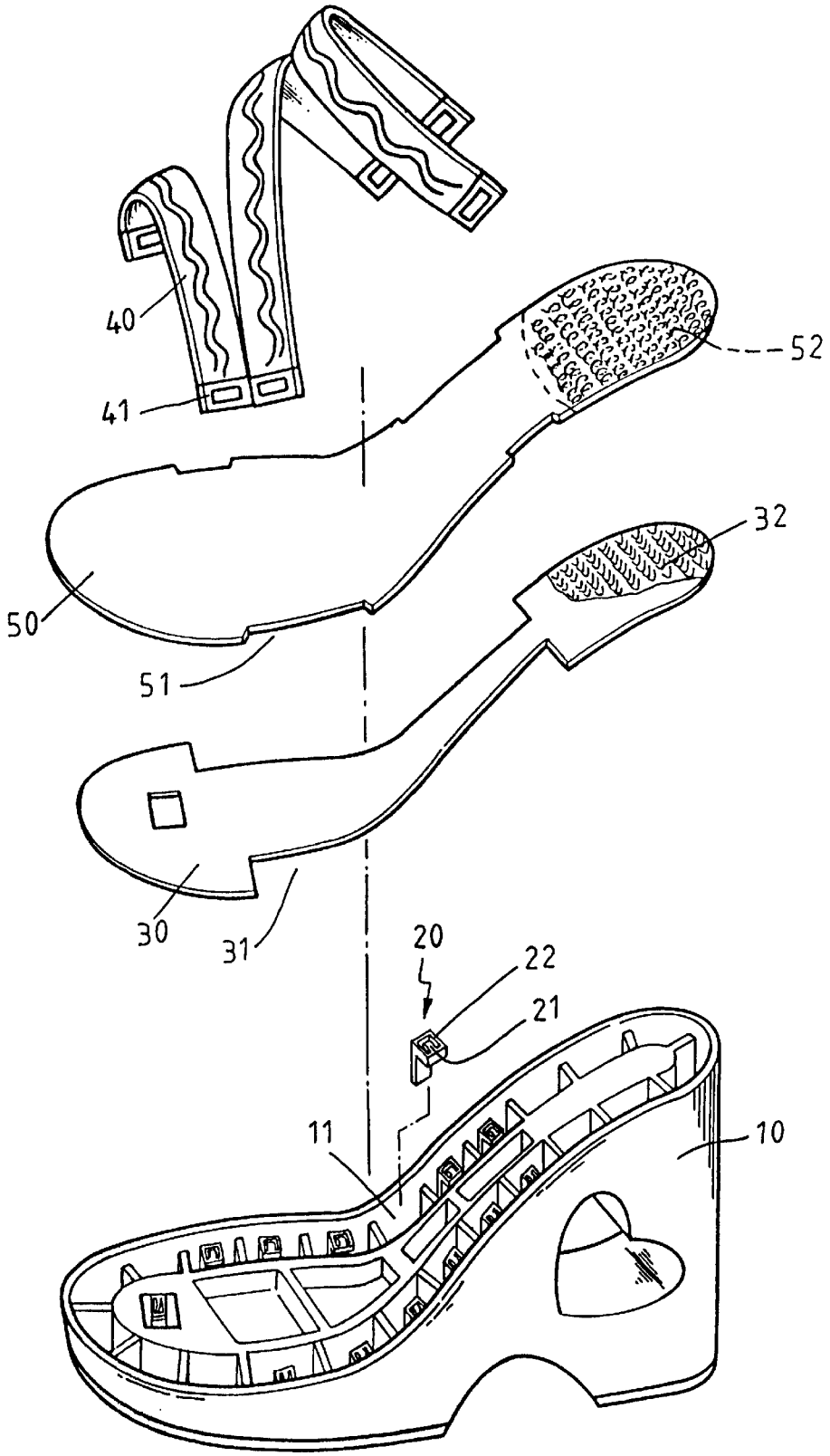
FIG. 4 shows an exploded view of the preferred embodiment of the present invention.
Figure 5:
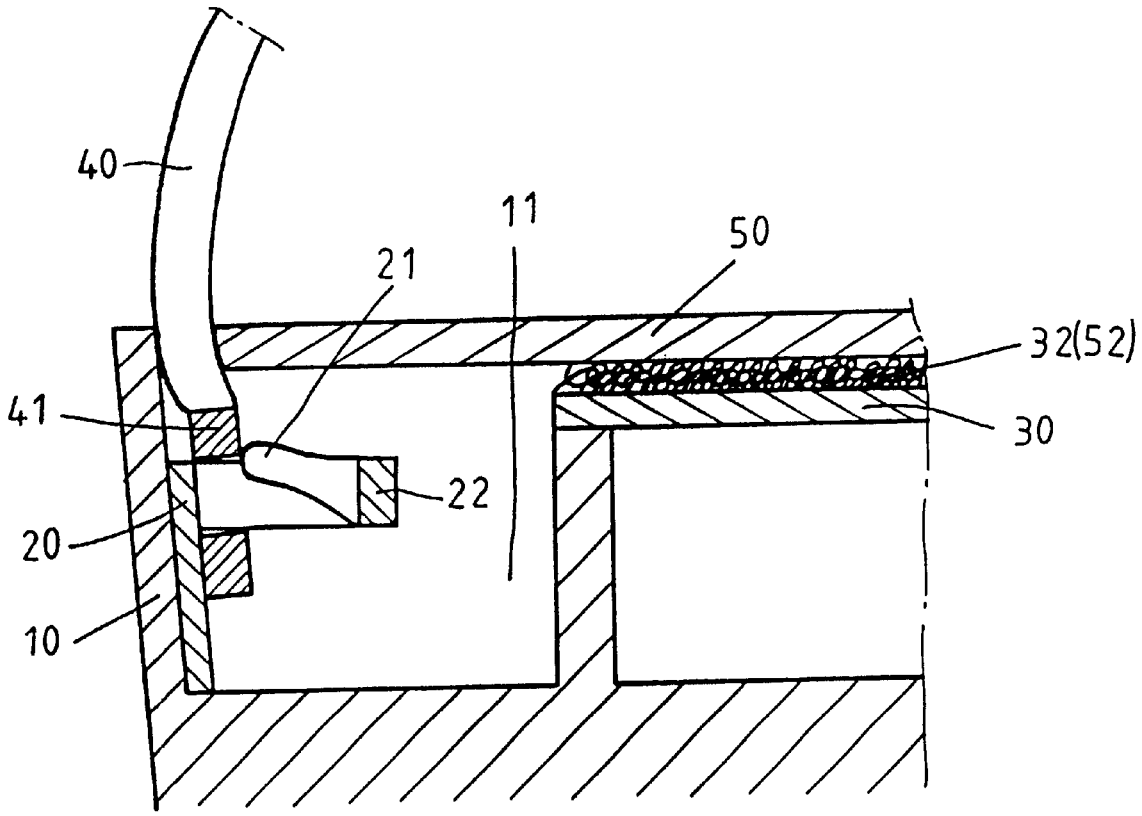
FIG. 5 shows a partial schematic plan view of the preferred embodiment of the present invention in combination.

As shown in FIGS. 4 and 5, a shoe structure embodied in the present invention comprises an outsole 10, a plurality of retaining blocks 20, an insole 30, an instep strap 40, and a shoe pad 50.

The outsole 10 has a recessed upper surface and a protruded fringe surrounding the upper surface. The supper surface is provided with a plurality of receiving spaces 11.

The retaining blocks 20 are integrally made of a rigid plastic material and are provided on a horizontal extension section 22 with a position confining portion 21 of a convex construction. The retaining blocks 20 are disposed securely in the receiving spaces 11 of the outsole 10.

The insole 30 is provided with two cuts 31 corresponding in location to the receiving spaces 11 of the outsole 10. The insole 30 is secured to the upper side of the outsole 10.

The instep strap 40 is provided at both longitudinal ends with a retaining piece 41 which is provided with one or more retaining holes.

The shoe pad 50 is provided with a plurality of cuts 51 corresponding in location to the instep strap 40. The shoe pad 50 is provided in the underside with a fastening structure, which is a male magic tape 52 engageable with a female magic tape 32 of the upper surface of the insole 30. The magic tapes 32, 52 refer to hook and loop structures, such as those available under the trademark VELCRO.

Figure 6:
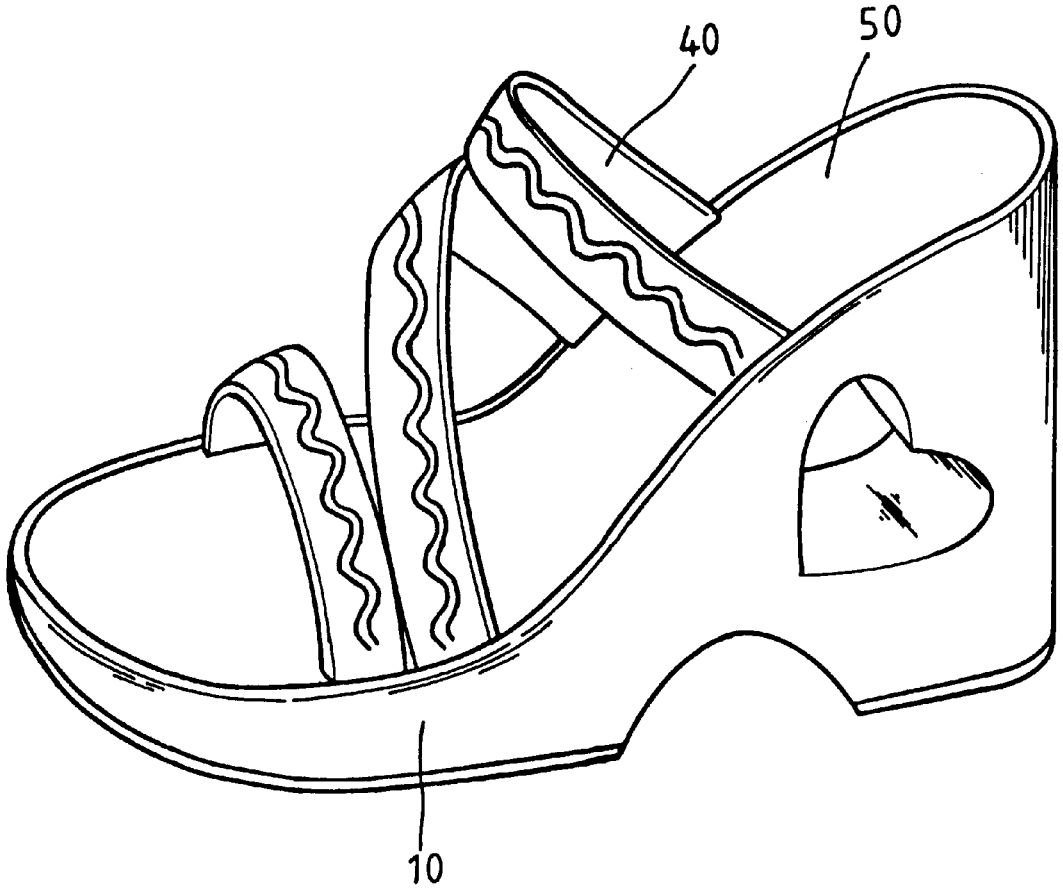
FIG. 6 shows a perspective view of the preferred embodiment of the present invention in combination.

As shown in FIGS. 5 and 6, the retaining blocks 20 are secured in place in the receiving spaces 11 of the outsole 10. The insole 30 is attached to the upper surface of the outsole 10 by an adhesive. The instep strap 40 is detachably fastened with the outsole 10 by the retaining piece 41 thereof. The retaining piece 41 has a hole which is aligned with the extension section 22 of the retaining block 20 before the elastic position confining portion 21 is pressed with finger via the hole such that the hole is caught by the convex position confining portion 21 upon the elastic recovery of the position confining portion 21. The shoe pad 50 is fastened with the insole 30 by the male magic tape 52 which is engaged with the female magic tape 32 of the insole 30.

Figure 7:
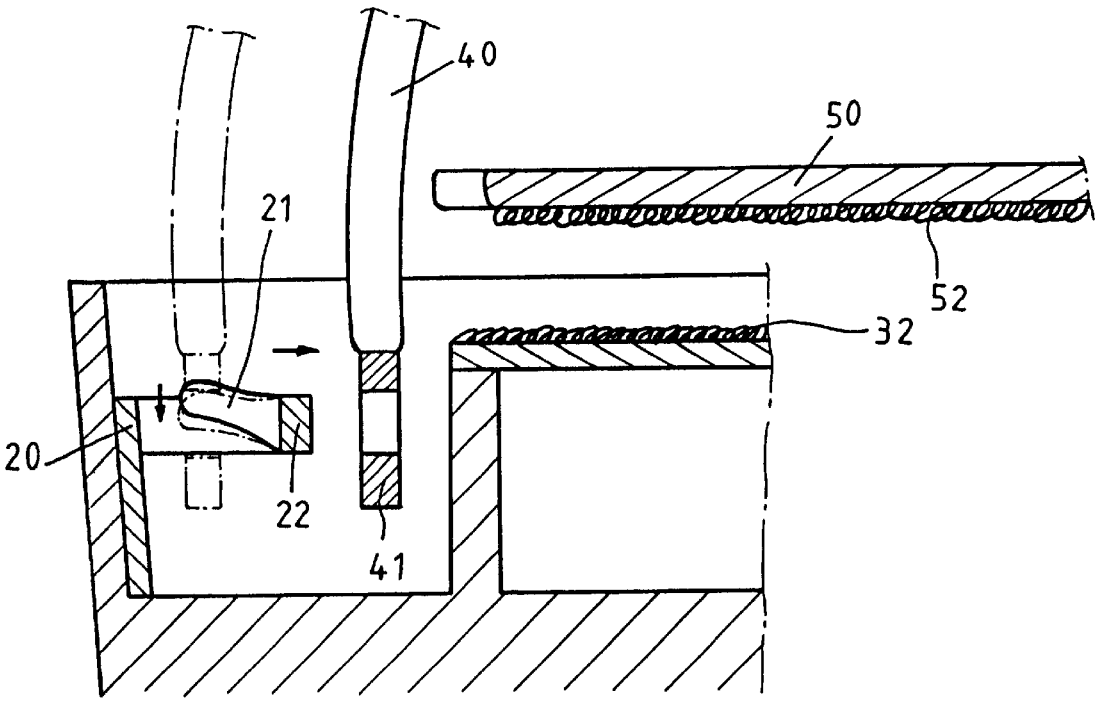
FIG. 7 shows a schematic view of separation of the retaining piece from the retaining block of the preferred embodiment of the present invention.

As shown in FIG. 7, the instep strap 40 can be easily separated from the outsole 10 by moving the retaining piece 41 of the instep strap 40 toward the free end of the extension section 22 of the retaining block 20. As the position confining portion 21 of the retaining block 20 is pressed, the retaining piece 41 of the instep strap 40 is let go. The magic tapes 52 and 32 serve to facilitate the easy fastening and unfastening of the shoe pad 50 with the insole 30.

Figure 8:
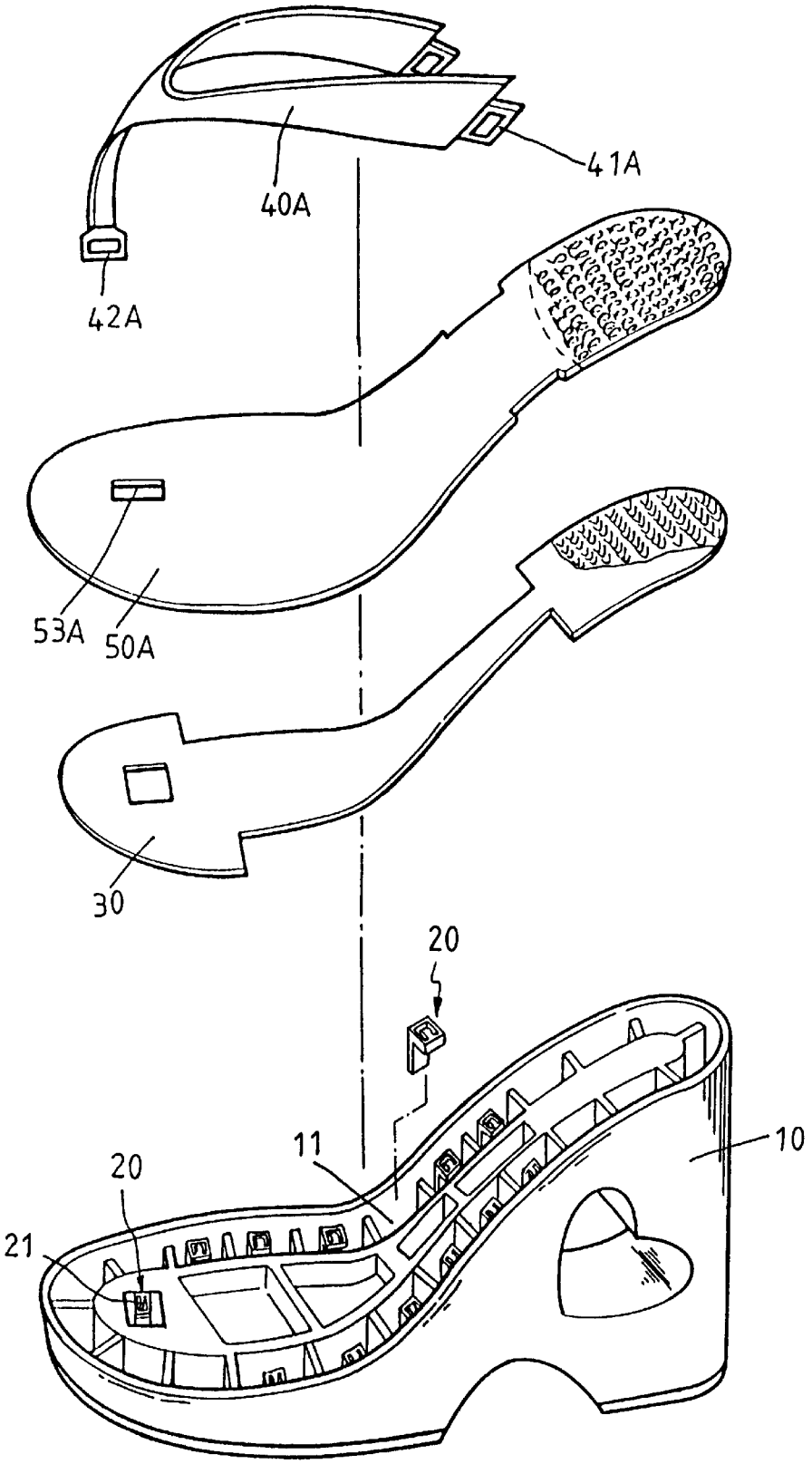
FIG. 8 shows an exploded view of a woman's shoe embodiment in the present invention.

As shown in FIG. 8, a vamp strap 40A is provided with a front retaining piece 42A and two rear retaining pieces 41A. The vamp strap 40 A is detachably fastened with the outsole 10 such that the front retaining piece 42A is engaged with the front retaining block 20 of the outsole 10 via a through hole 53A of a shoe pad 50A, and that the two rear retaining pieces 41A of the vamp strap 40A are engaged with two appropriate retaining blocks 20 of the outsole 10.

Figure 9:
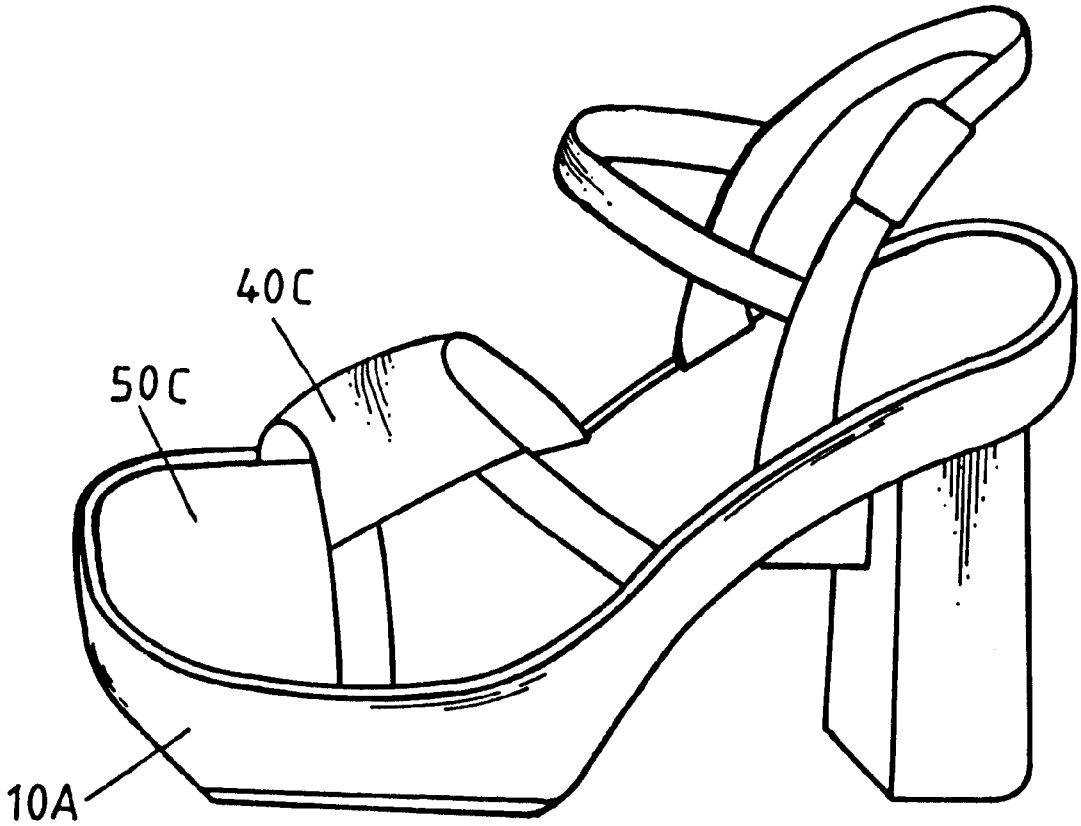
FIG. 9 shows a perspective view of another woman's shoe embodied in the present invention.

As shown in FIG. 9, a woman's shoe embodied in the present invention comprises an outsole 10A, a shoe pad 50C, and an instep strap 40C which is retained by the outsole 10A in the same manner as illustrated in FIGS. 4 and 7.

Figure 10:
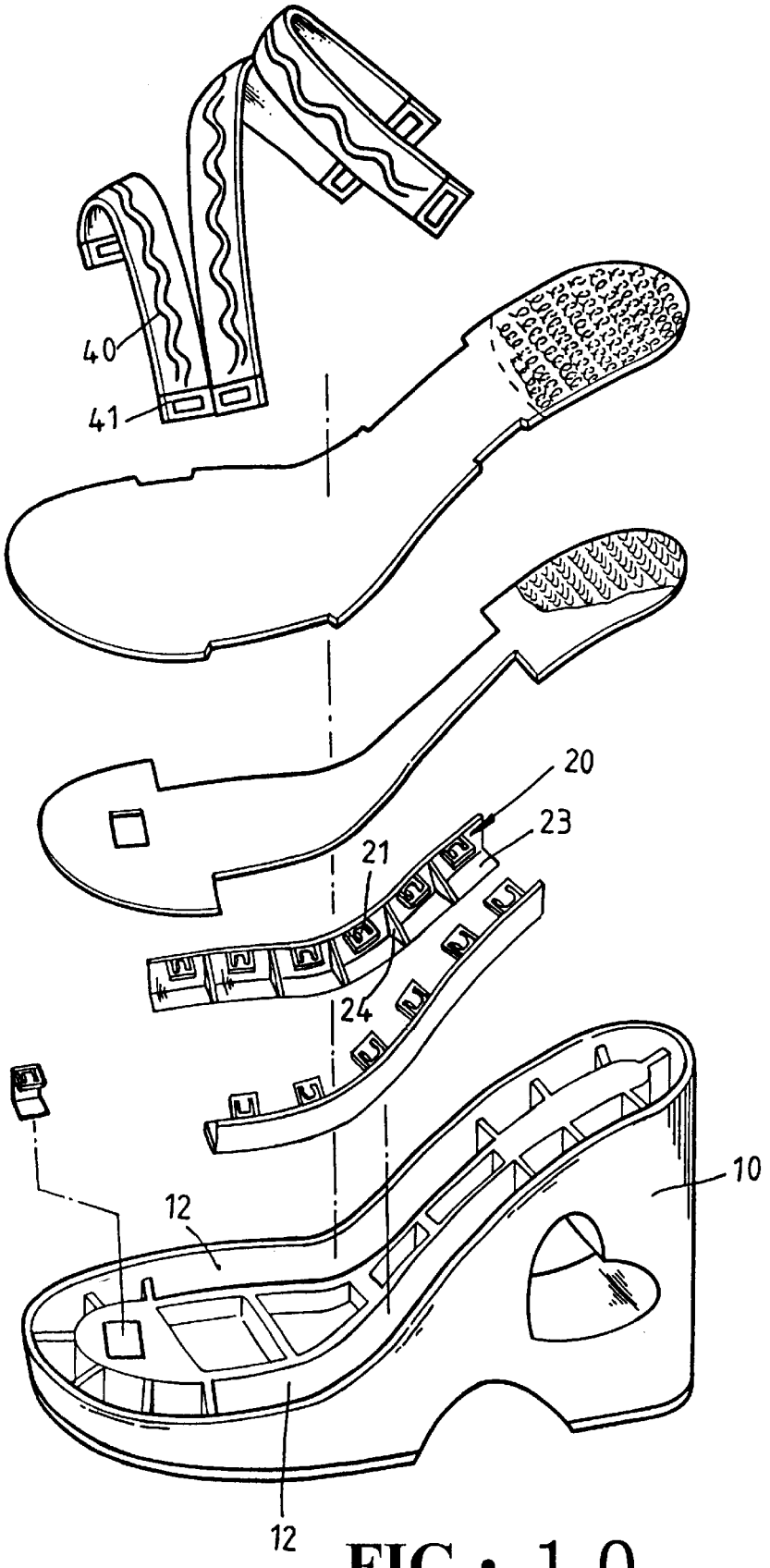
FIG. 10 is an exploded view to show the structure of a modified retaining block of the present invention.

As shown in FIG. 10, a shoe embodied in the present invention comprises an outsole 10 which is provided with two longitudinally-oriented receiving spaces 12 and two elongated seats 23 received in the receiving spaces 12. The elongated seats 23 are provided with a plurality of ribs 24, and retaining blocks 20 which are in turn provided with a position confining portion 21 for retaining the retaining piece 41 of the instep strap 40.

As shown in FIG. 11, a retaining block 20A embodied in the present invention is extend horizontally and is provided at the top with a convex position confining portion 21A and in the underside with a guide piece 25A extending outwards. The guide piece 25A is intended to guide the retaining piece 41 of the instep strap 40 to facilitate the engaging of the retaining piece 41 with the position confining portion 21A. The instep strap 40 is separated from the outsole by moving the retaining piece 41 of the instep strap 40 in an outward direction to move pass the position confining portion 21A.

As shown in FIGS. 12 and 13, a retaining block 20B embodied in the present invention is provided with an insertion slot 26B, a position confining portion 21B, and a press block 27B. A vamp strap 40B has a retaining piece 41B which is in turn provided with a retaining portion 43B extending outwards. The retaining piece 41B of the vamp strap 40B is inserted into the insertion slot 26B of the retaining block 20B such that the retaining portion 43B of the retaining piece 41B urges the position confining portion 21B of the retaining block 20B.

The vamp strap 40B is separated from the outsole by pressing the press block 27B of the retaining block 20B, thereby causing the press block 27B to force the retaining portion 43B of the retaining piece 41B to displace inwards so as to result in the disengagement of the retaining piece 41B of the vamp strap 40B with the retaining block 20B.

As shown in FIG. 14, the present invention comprises an insole 30A and a shoe pad 50B, which are joined together by a plurality of projections 54B and a plurality of blind holes 33A in which the projections 54B are retained. The projections 54B are disposed in the underside of the shoe pad 50B, whereas the blind holes 33A are disposed in the upper side of the insole 30A.

The present invention described above is to be regarded in all respects as being merely illustrative and not restrictive. Accordingly, the present invention may be embodied in other specific forms without deviating from the spirit thereof. The present invention is therefore to be limited only by the scopes of the following claims.

What is claimed is:

1. A footwear comprising:

an outside provided in an upper side thereof with a plurality of receiving spaces;

a plurality of retaining blocks each of which is disposed in a respective one of the receiving spaces of said outsole, said retaining blocks each comprises an extension section having a position confining portion;

an insole fastened to the upper side of said outsole;

a shoe pad fastened to an upper side of said insole; and at least one instep strap having two longitudinal ends, each of the longitudinal ends including a retaining piece having a central hole, whereby the central hole of each one of said instep straps is detachably slid into a respective one of the retaining pieces of said instep strap so that respective ones of said retaining pieces are secured to respective ones of said retaining blocks by the respective ones of said position confining portions which are elastically bendable to permit entry and removal of respective ones of said retaining pieces, the retaining pieces acting as a barrier that prevents upward pull of the at least one instep strap.

2. The footwear as defined in claim 1, wherein the position confining portions of said extension sections are each provided a convex surface.

3. The footwear as defined in claim 1, wherein said retaining blocks are further provided in said extension section with a guide piece whereby said guide piece is intended to guide said retaining piece of said instep strap to engage said position confining portion.

4. The footwear as defined in claim 1, wherein a hook and loop structure is secured to an underside of said shoe pad and an upper side of said insole such that said shoe pad is detachably fastened to said insole.

5. The footwear as defined in claim 1, wherein said shoe pad is provided in an underside with a plurality of projections; wherein said insole is provided in an upper side with a plurality of retaining holes corresponding in location to said projections of said shoe pad whereby said shoe pad is fastened with said insole such that said projections of said shoe pad are retained in said retaining holes of said insole.

6. The footwear as defined in claim 1, wherein said outsole is provided in the upper side thereof with a plurality of elongated receiving spaces; wherein said retaining blocks are integrally made with a plurality of elongated seats whereby said elongated seats are disposed in said elongated receiving spaces of said outsole.

7. The footwear as defined in claim 1, wherein said retaining blocks are provided with an insertion slot, a position confining portion, and a press block; wherein said instep strap is provided in said retaining piece with a retaining portion extending therefrom whereby said instep strap is fastened detachably with said outsole such that said retaining portion of said retaining piece of said instep strap is inserted into said insertion slot of said retaining blocks, and that said retaining portion of said retaining piece of said instep strap urges said position confining portion of said retaining block, said instep strap capable of being separated from said outsole by an external force exerting on said press block of said retaining blocks, thereby causing said press block to force said retaining portion of said retaining piece of said instep strap to displace to result in the disengagement of said retaining piece of said instep strap with said retaining block of said outsole.

* * * * *